US006400071B1

(12) United States Patent
Lee et al.

(10) Patent No.: US 6,400,071 B1
(45) Date of Patent: Jun. 4, 2002

(54) FIELD EMISSION DISPLAY DEVICE HAVING A SURFACE CONDUCTION TYPE ELECTRON EMITTING SOURCE

(75) Inventors: Chun-Gyoo Lee, Kyungki-do; Chan-Jae Lee, Seoul, both of (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 09/536,873

(22) Filed: Mar. 27, 2000

(30) Foreign Application Priority Data

Jan. 5, 2000 (KR) ..... 2000-346

(51) Int. Cl.[7] ..... H01J 1/304; H01J 19/10

(52) U.S. Cl. ..... 313/310; 313/309; 313/336

(58) Field of Search ..... 313/293, 308, 313/310, 336, 351, 495, 496, 497, 631, 309

(56) References Cited

U.S. PATENT DOCUMENTS 5,530,314 A * 6/1996 Banno et al. ..... 313/310
5,650,795 A * 7/1997 Banno et al. ..... 345/74

* cited by examiner

*Primary Examiner*—Nimeshkumar D. Patel
*Assistant Examiner*—Thelma Sheree Clove
(74) *Attorney, Agent, or Firm*—Christie, Parker & Hale, LLP

(57) ABSTRACT

The rear substrate of an FED comprises data electrodes formed on a surface of the substrate, an insulating layer over the substrate covering the data electrodes, scan and common electrodes laterally disposed on the insulating layer such that they are parallel with each other and electron emitting elements, which emit electrons when they subject to electric field, connected between a scan electrode and a common electrode. The electron emitting elements have a middle portion narrower than end portions so that electron emitting surface area is located at a same location from emitter to emitter.

8 Claims, 4 Drawing Sheets

FIELD EMISSION DISPLAY DEVICE HAVING A SURFACE CONDUCTION TYPE ELECTRON EMITTING SOURCE

FIELD OF THE INVENTION

The present invention relates to an FED and, more particularly, to an electrode arrangement on the rear substrate.

BACKGROUND OF THE INVENTION

As shown in FIG. 7 a conventional FED is comprised of two spaced apart substrates on one of which are formed a plurality of pairs of electrodes 3,5 with electron emitters between them. One electrode 3 serves as scanning electrode while the other electrode as data electrode. On undersurface of the second substrate 9 facing the first substrate 1 are formed transparent anode electrodes 11 and a phosphor layer 13 on top of them. When a predetermined voltage is applied between the scan electrode and data electrode a portion 7*a* of the emitter 7 begins to emit electrons which are induced toward the anodes to collide with the phosphor. Here when a pulse width modulated (PWM) pulse is used to drive the scan electrodes a negative voltage over a threshold is applied to the scan electrode and a positive voltage corresponding to a desired level of brightness is applied to the data electrode. However, the aforementioned conventional electrode structure has a drawback of deviation of individual devices from the standard during mass production. More specifically the threshold voltage may vary from one device to another. The result is that some may not be able to display a gray scale image and others lower brightness and contrast. Moreover, this conventional structure requires a large amount of current in the data electrodes and thus high power IC drivers making such devices less attractive commercially.

SUMMARY OF THE INVENTION

It is an objective of the present invention to provide an electrode structure that is able to prevent low contrast/brightness of a displayed image due to variation of required threshold voltage to cause emission of electrons from the emitters. It is another objective of the present invention to ensure electron emission from a designated portion of electron emitters. The rear substrate of an FED comprises data electrodes formed on a surface of the substrate, an insulating layer over the substrate covering the data electrodes, scan and common electrodes laterally disposed on the insulating layer such that they are parallel with each other and electron emitting elements, which emit electrons when they subject to electric field, connected between a scan electrode and a common electrode. The electron emitting elements have a middle portion narrower than end portions so that electron emitting surface area is located at a same location from emitter to emitter.

DETAILED DESCRIPTION OF THE PRESENT INVENTION

Figure 1:
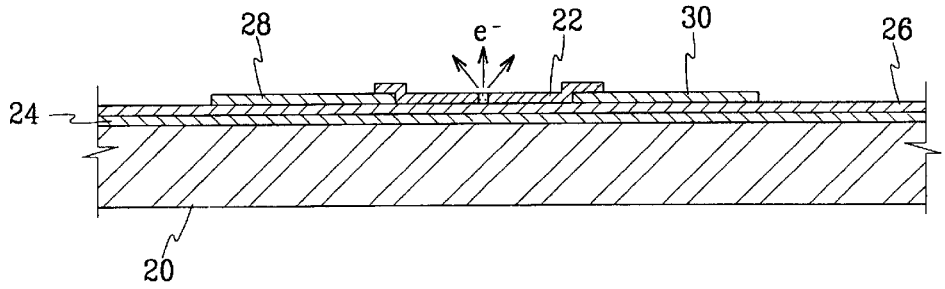
FIG. 1 is a cross section of the rear substrate of an FED according to the present invention.
Figure 2:
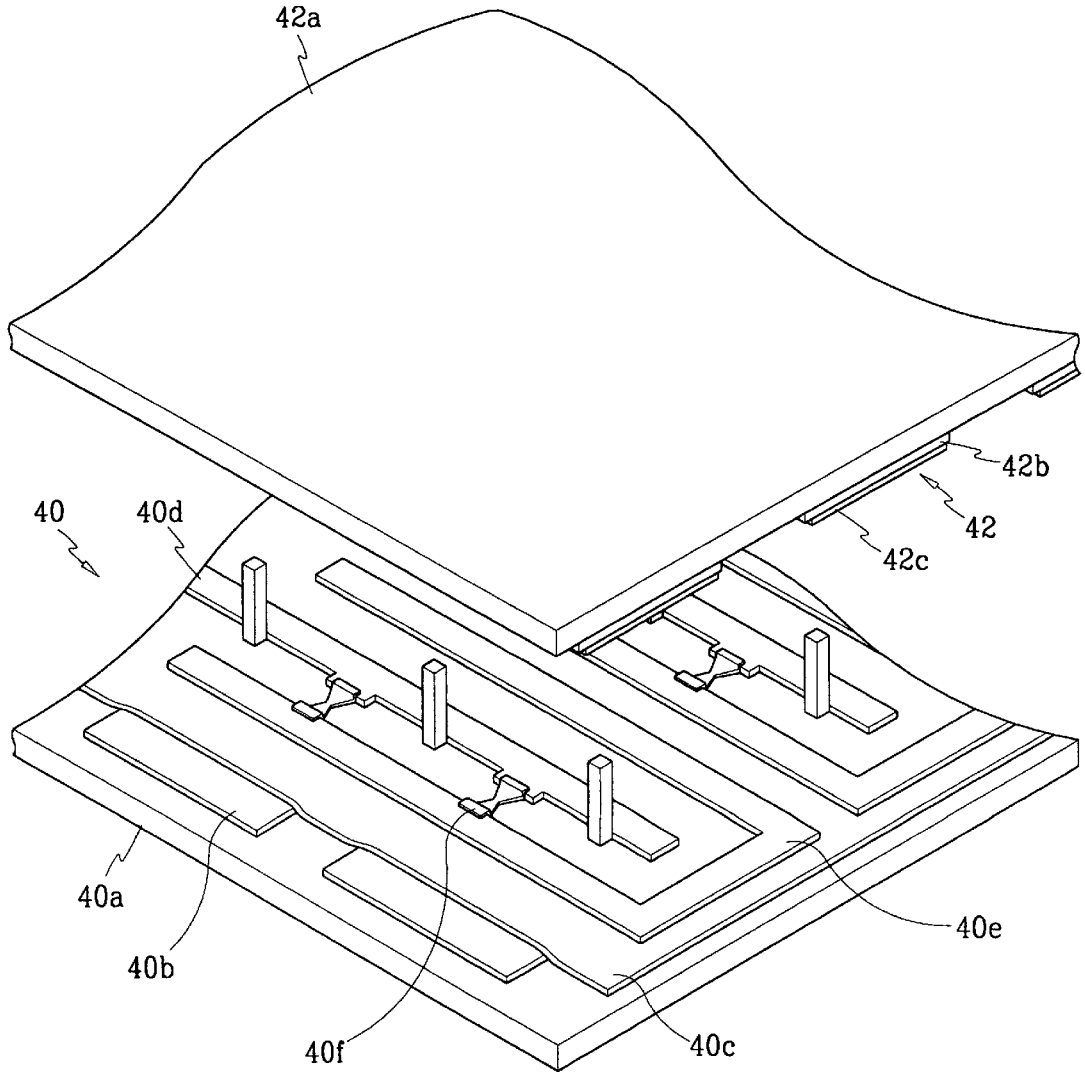
FIG. 2 is a perspective view of an FED according to the present invention.

FIG. 1 shows a cross section of a rear substrate assembly according to the present invention. It is comprised of a base substrate 20,40*a* and a plurality of parallel data electrodes 24, an insulating layer 26,40*c* a plurality of scan electrodes 28,40*b* and common electrodes 30,40*e* which are disposed in a direction parallel to that of the scan electrodes. To the data electrodes are applied a varying voltage corresponding to the gray level of selected pixels. A plurality of electron emitters 22 are disposed between each of the scan electrodes and its adjacent common electrode at intersections of the scan electrode and the data electrodes. In operation when a threshold voltage is applied to the scan electrode an electric field is generated between the scan electrode and the common electrode, which is at the ground potential. The electric field forces a current flow in the emitters in a direction parallel with the surface of the emitter 40, which current in turn causes electrons to emit from the surface of the emitters. Thus emitted electrons are accelerated toward a front substrate 42*a*, on the undersurface 42 of which high voltage anode electrodes 42*b* are disposed and collide with phosphors 42*c* coated on the anode electrodes 42*b*, as shown in FIG. 2. With this inventive structure contrast and brightness non-uniformity or deterioration is prevented that would otherwise have occurred due to individual deviation in a mass production stage. The advantage is obtained by the ability to adjust analog voltage signals to the data electrodes 40*b* insulated from the scan electrodes to control the channel resistance of the semiconductive emitters and in turn the amount of electron emission from the emitters. Additionally since the data electrodes are insulated from the scan electrodes excessive current is prevented. This feature of the invention allows use of much cheaper low-current and low-voltage driver IC's.

Figure 3:
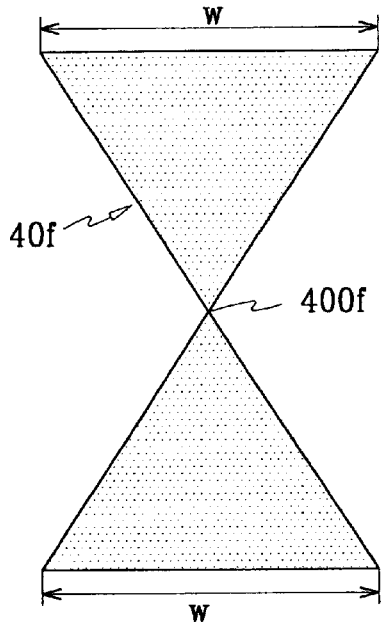
FIG. 3 is a shape of an electron emitter according to the present invention.
Figure 4:
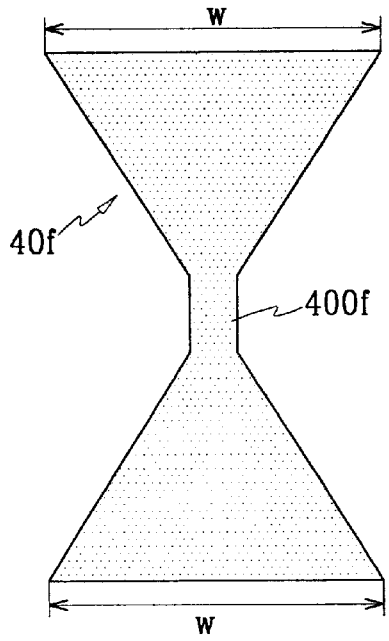
FIG. 4 is a shape of an electron emitter according to the present invention.

The electron emission mostly occurs in a middle area of each emitter when it is subject to an electric field along its length. A threshold voltage required to generate enough electric field to induce electron emission is applied to the scan electrode. According to the present invention the middle area of emitters is made much narrower than both ends that are connected to the scan electrode and a common electrode respectively. FIG. 3 and FIG. 4 illustrate two of such emitter 40*f* shapes where a middle portion is narrower. Unlike a conventional rectangular or square emitter where electron emission area may vary from emitter to emitter, an electron emission 400*f* area of the inventive emitters allows emission of electrons from the substantially same location since most of the emission takes place at the narrow portion.

Figure 5:
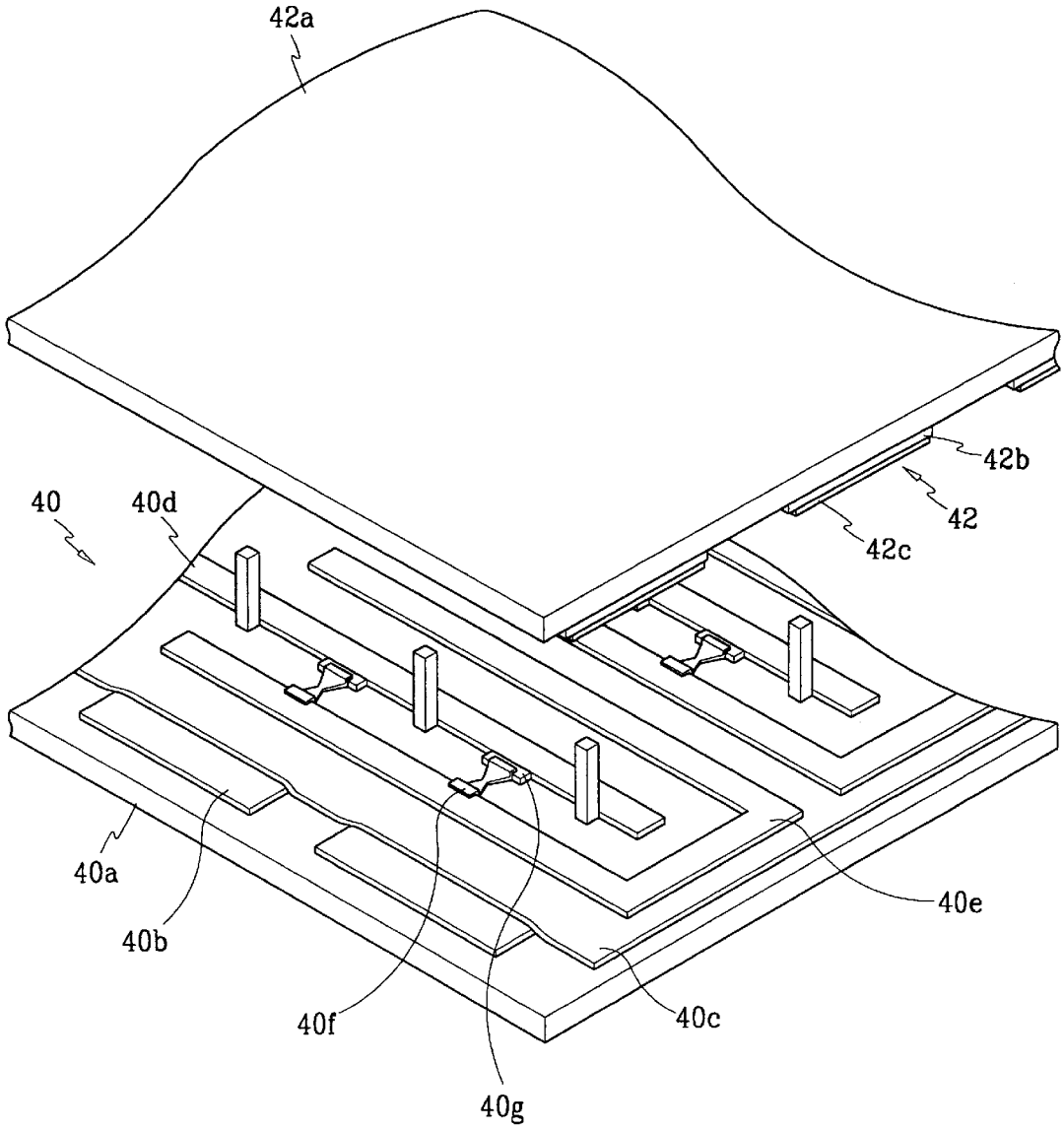
FIG. 5 is a perspective view of an FED according to the present invention.
Figure 6:
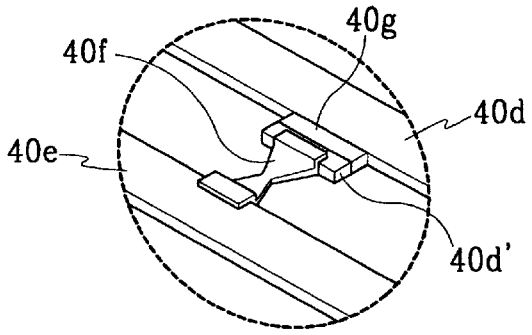
FIG. 6 is an enlarged view of an emitter according to the present invention.
Figure 7:
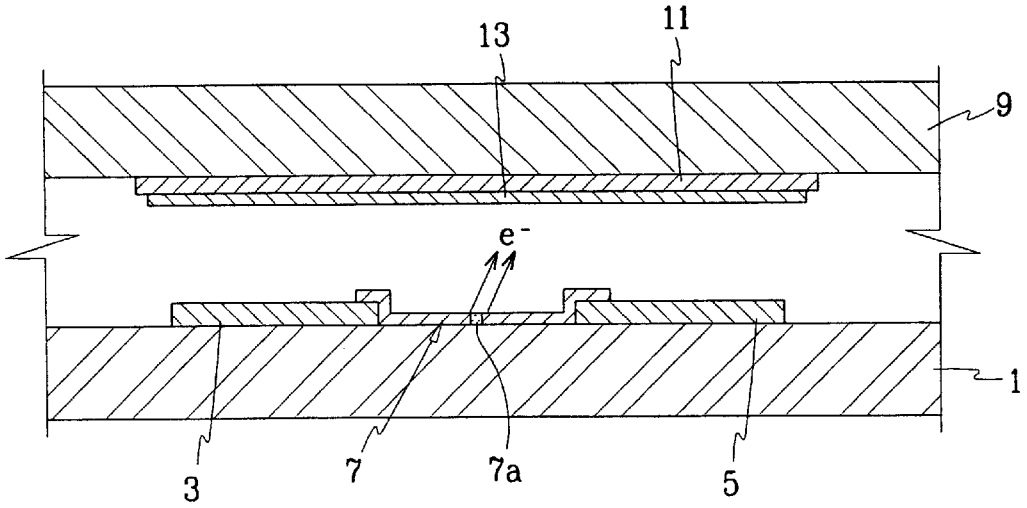
FIG.7(PRIOR ART)
FIG. 7 is a cross section of the rear substrate of a conventional FED.

FIG. 5 illustrates a second embodiment of the present invention, which comprises a means of controlling electron emission from electron emitters by providing a current control means between a scan electrode and an electron emitter. More specifically, the current control means comprises a resistor 40*g* that is disposed between an emitter 40*f* and a scan electrode 40*d*. Alternatively, it may be indirectly connected to the emitter 40*f* via an island-like contact electrode 40*d*' which is in close electrical contact with the emitter, as shown in FIG. 6. The provision of the resistor allows adjustment of current flow from the scan electrode to the emitter such that the current is uniform. It also prevents excessive current when an emitting area is not properly formed.

What is claimed is:

1. A field emission display comprising:

a substrate having a plurality of single electrodes;

an electrically insulating layer over said single electrodes;

a plurality of electrode pairs on said insulating layer; and a plurality of electron emitters disposed between each of the electrode pairs, wherein said electron emitters are narrower at a middle portion than at each opposing end portion, the end portions each being in electrical contact with one of their respective electrode pairs, whereby when a voltage is applied between said electrode pairs, electrons are emitted from the surface of their respective electron emitters.

2. A field emission display comprising:

a substrate having a plurality of single electrodes;

an electrically insulating layer over said single electrodes;

a plurality of electrode pairs on said insulating layer; and a plurality of electron emitters disposed between each of the electrode pairs, wherein said electron emitters each comprise an hour glass shape;

whereby when a voltage is applied between said electrode pairs, electrons are emitted from the surface of their respective electron emitters.

3. A field emission display comprising:

a substrate having a plurality of single electrodes;

an electrically insulating layer over said single electrodes;

a plurality of electrode pairs on said insulating layer;

a plurality of electron emitters disposed between each of the electrode pairs, wherein said electron emitters are narrower at a middle portion than at each opposing end portion; and means for controlling current flowing in each of said electron emitters.

4. The field emission display of claim 3, wherein said means for controlling current comprises a plurality of resistors each being disposed between one of the electron emitters and one electrode of the respective electrode pair of said one of the electron emitters.

5. A field emission display comprising:

a substrate having a plurality of single electrodes;

a plurality of electrode pairs;

an electrically,insulating layer between the single electrodes and the electrode pairs; and a plurality of electron emitters disposed between each of the electrode pairs, wherein said electron emitters each are narrower at a middle portion than at opposing end portions, the end portions each being in electrical contact with one of their respective electrode pairs.

6. A field emission display comprising:

a substrate having a plurality of single electrodes;

a plurality of electrode pairs;

an electrically insulating layer between the single electrodes and the electrode pairs; and a plurality of electron emitters disposed between each of the electrode pairs, wherein said electron emitters each comprise an hour glass shape.

7. A field emission display comprising:

a substrate having a plurality of single electrodes;

a plurality of electrode pairs;

an electrically insulating layer between the single electrodes and the electrode pairs;

a plurality of electron emitters disposed between each of the electrode pairs, wherein said electron emitters each are narrower at a middle portion than at opposing end portions, the end portions each being in electrical contact with one of their respective electrode pairs; and a plurality of current controllers each being disposed between one of the electron emitters and one electrode of the respective electrode pair of said one of the electron emitters.

8. The field emission display of claim 7, wherein each of the current controllers comprises a resistor.

* * * * *